US006511405B1

(12) United States Patent
Focke et al.

(10) Patent No.: US 6,511,405 B1
(45) Date of Patent: Jan. 28, 2003

(54) PROCESS AND APPARATUS FOR PRODUCING CIGARETTE PACKS

(75) Inventors: Heinz Focke, Verden (DE); Thomas Häfker, Langwedel (DE)

(73) Assignee: Focke & Co (GmbH & Co), Verden (DE)

( * ) Notice: Subject to any disclaimer, the term of this patent is extended or adjusted under 35 U.S.C. 154(b) by 71 days.

(21) Appl. No.: 09/663,469

(22) Filed: Sep. 15, 2000

(51) Int. Cl.[7] ..... B31B 1/48

(52) U.S. Cl. ..... 493/70; 493/129; 53/234; 53/557

(58) Field of Search ..... 53/557, 463, 477, 53/476, 376.7, 377.8, 234; 493/129, 133, 70

(56) References Cited

U.S. PATENT DOCUMENTS 3,166,462 A * 1/1965 Schoder ..... 53/463
3,600,875 A * 8/1971 Buob et al. ..... 53/557
4,843,800 A * 7/1989 Focke ..... 53/477
4,870,802 A * 10/1989 Cerf ..... 53/557

FOREIGN PATENT DOCUMENTS

| | | |
|---|---|---|
| DE | 3638627 | 5/1988 |
| DE | 3718702 | 12/1988 |
| DE | 3824924 | 1/1990 |

* cited by examiner

*Primary Examiner*—Rinaldi I. Rada
*Assistant Examiner*—Thanh Truong
(74) *Attorney, Agent, or Firm*—Abelman, Frayne & Schwab

(57) ABSTRACT

In order to improve the outer appearance of (cigarette) packs (10) of the hinge-lid-box type, said packs, once an outer wrapper (13) has been provided and sealed, are conveyed through a shrinking station (26) and subjected to the action of heat in the region of the large-surface-area pack sides, in particular in the region of upwardly directed front sides. For this purpose, heating plates (32, 33) are positioned in the region of the shrinking station (26) and transmit heat to the upwardly directed surfaces of the packs (10).

14 Claims, 6 Drawing Sheets

Figure 1:
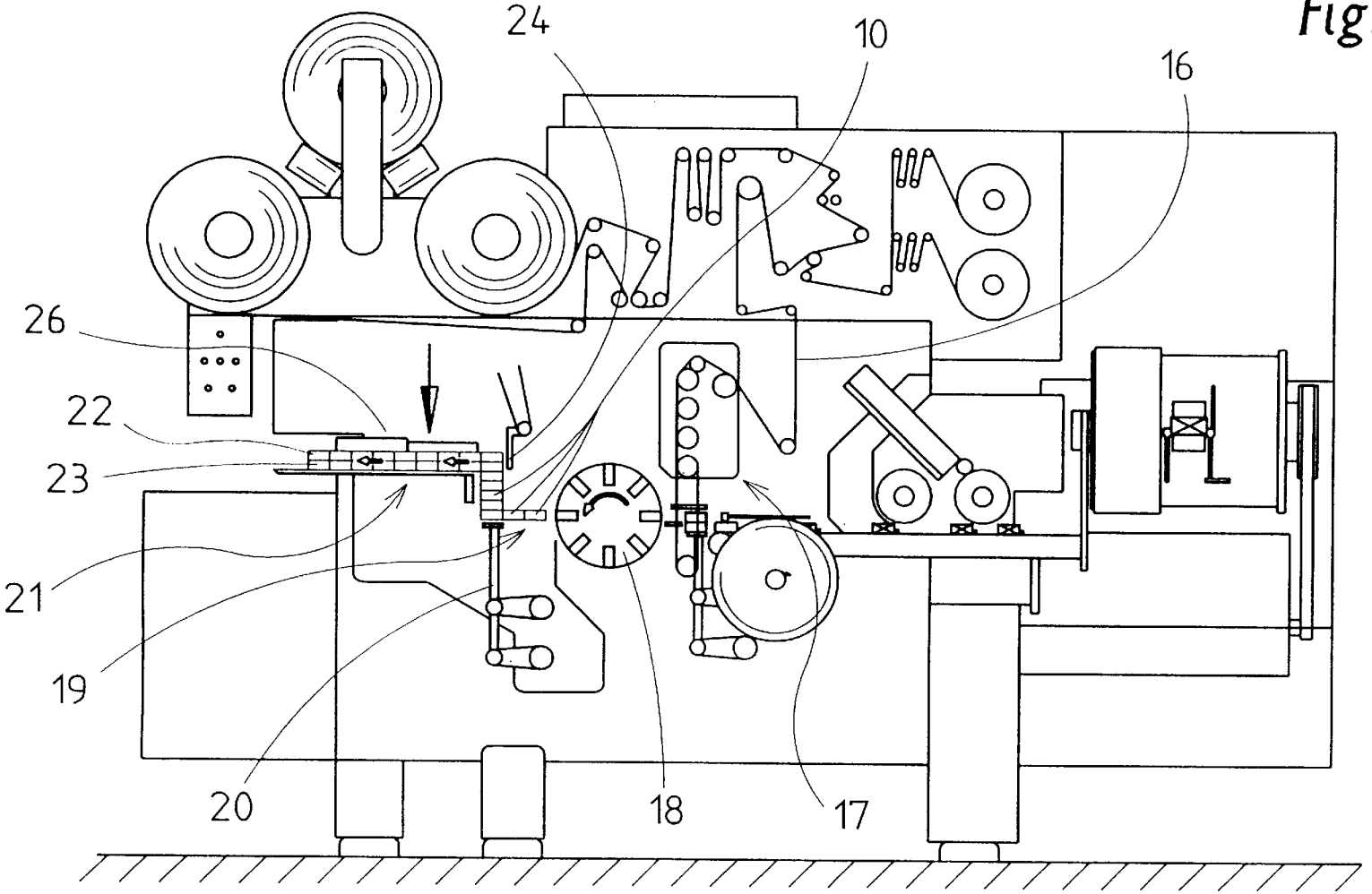

57
64
54
28
65
32
30
25
26
43
54
IV
41
69
45
57
53
53
44
31
45
54
40
43
30
14
52
12
11
II
II
33
53
47
46
10
31
15
53
26
25
67
IV
29
66

29
57
65
55
45
54
27
61
59
60
62
22
41
44
64
51
32
50
49
28
57
55
46
67
53
66
68
61
33
54
45
61
53
23
63

PROCESS AND APPARATUS FOR PRODUCING CIGARETTE PACKS

DESCRIPTON

The invention relates to a process for producing packs with an outer wrapper made of film, in particular hinge-lid boxes for cigarettes, a film blank which is folded around the pack having folding tabs which are connected to one another by thermal sealing. The invention also relates to an apparatus for carrying out the process.

Cigarette packs, in particular hinge-lid boxes, are usually constructed such that an outer wrapper made of film encloses the pack. Folding tabs of the outer wrapper, in the region of a narrow side wall and in the region of the end wall and base wall, are connected to one another by thermal sealing.

The quality, namely the outer appearance, of cigarette packs has to meet ever more stringent requirements. This also applies to the outer wrapper of the cigarette pack, in particular hinge-lid box.

Accordingly, the object of the invention is to propose measures, for the treatment of the pack provided with an outer wrapper made of film, which improve the outer appearance of the outer wrapper, in particular in the case of hinge-lid boxes for cigarettes.

In order to achieve this object, the process according to the invention is characterized by the following features:

a) during the production of packs of the hinge-lid type, said packs are transported in a plurality of, in particular two, pack rows arranged one above the other along a straight conveying path for the purpose of sealing laterally directed folds in the region of end wall and base wall, b) following the sealing of the end walls and base walls, the cyclically transported pack rows are subjected to heat treatment in the vicinity of the conveying path, preferably (only) in the region of the upward-facing front sides of the packs.

According to the process of the invention, the thermal sealing of folding tabs and a shrinkage process are thus carried out in successive steps in the region of a straight conveying path. The shrinkage process is preferably carried out such that heat for shrinking is applied merely to the upwardly directed front sides of the packs or film.

In the case of the apparatus according to the invention, the packs are conveyed, preferably discontinuously, through the sealing station and the following shrinking station in two pack rows located one above the other. In this case, the upwardly directed front sides of the packs are subjected to heat treatment by way of the abutment of heating plates. According to the invention, the top pack row is raised slightly in the region of the shrinking station, with the result that a heating element, in particular a heating plate, can act in the region of the bottom pack row.

A further special feature of the invention is the design of the heating plates such that a very rapid, effective change in the heating temperature is made possible. As a result, the heating and/or shrinking station can be quickly adapted to different operating states of the packaging machine, in particular to different conveying speeds.

Figure 2:
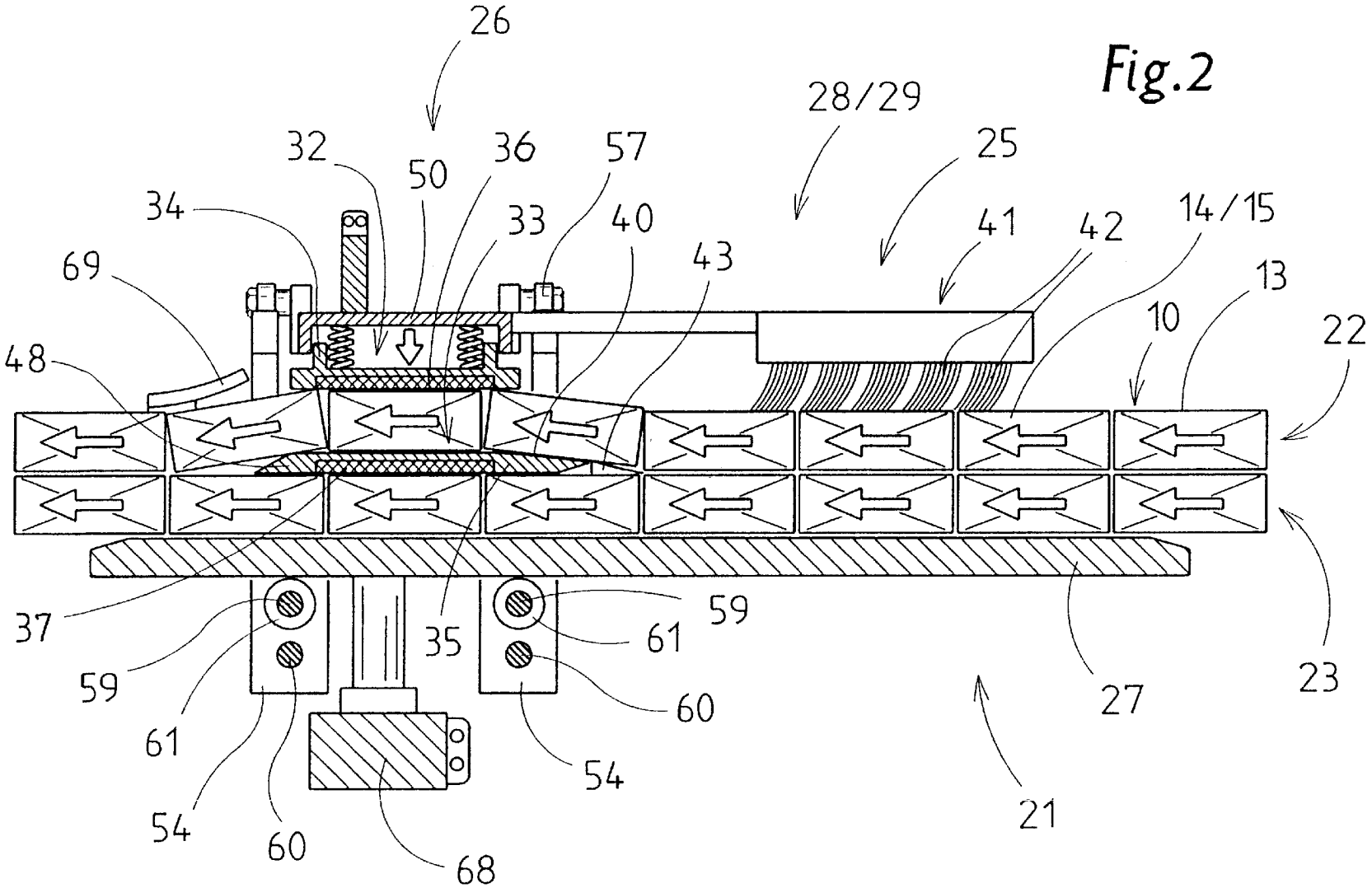
Figure 3:
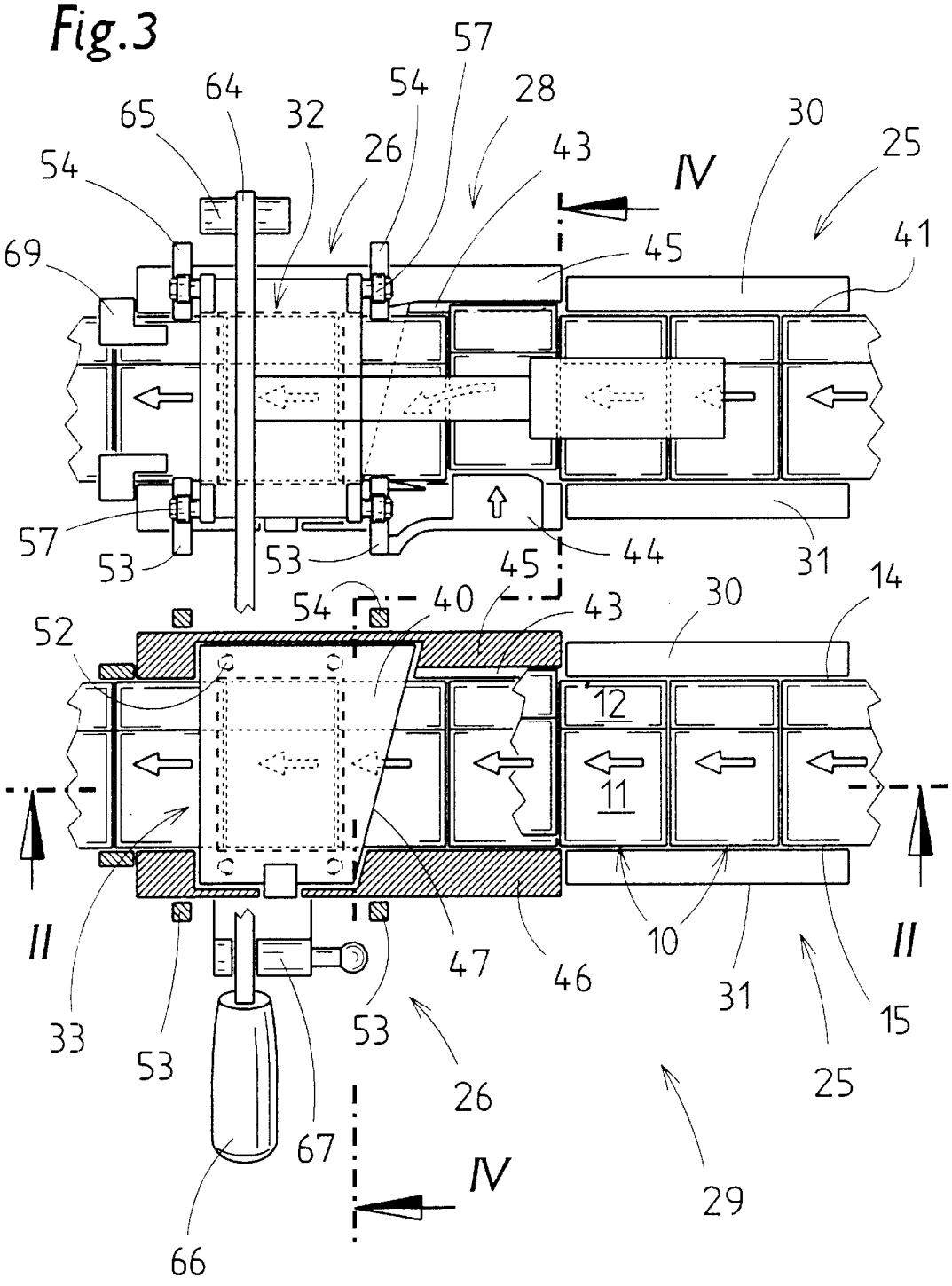
Figure 4:
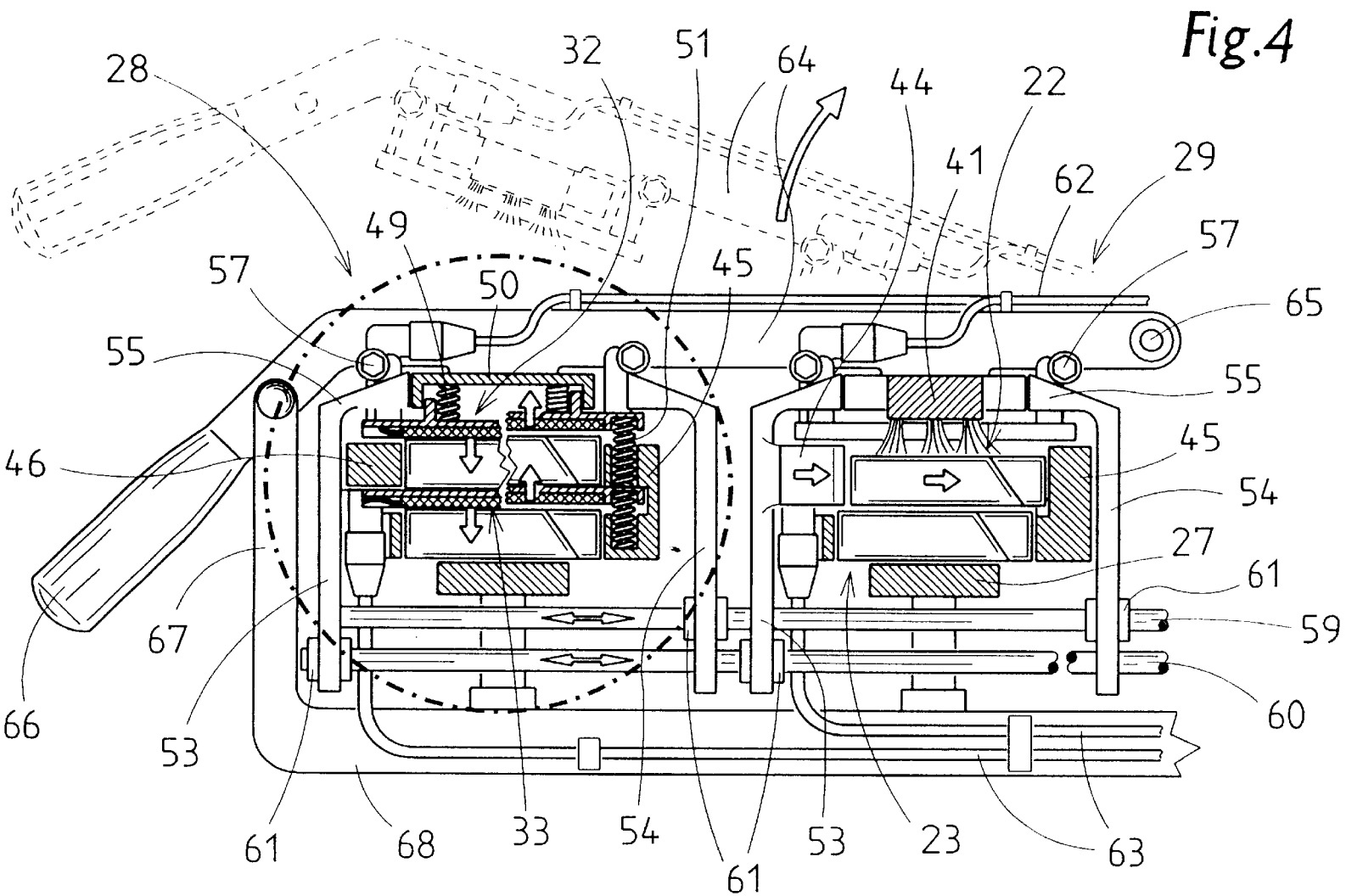
Figure 6:
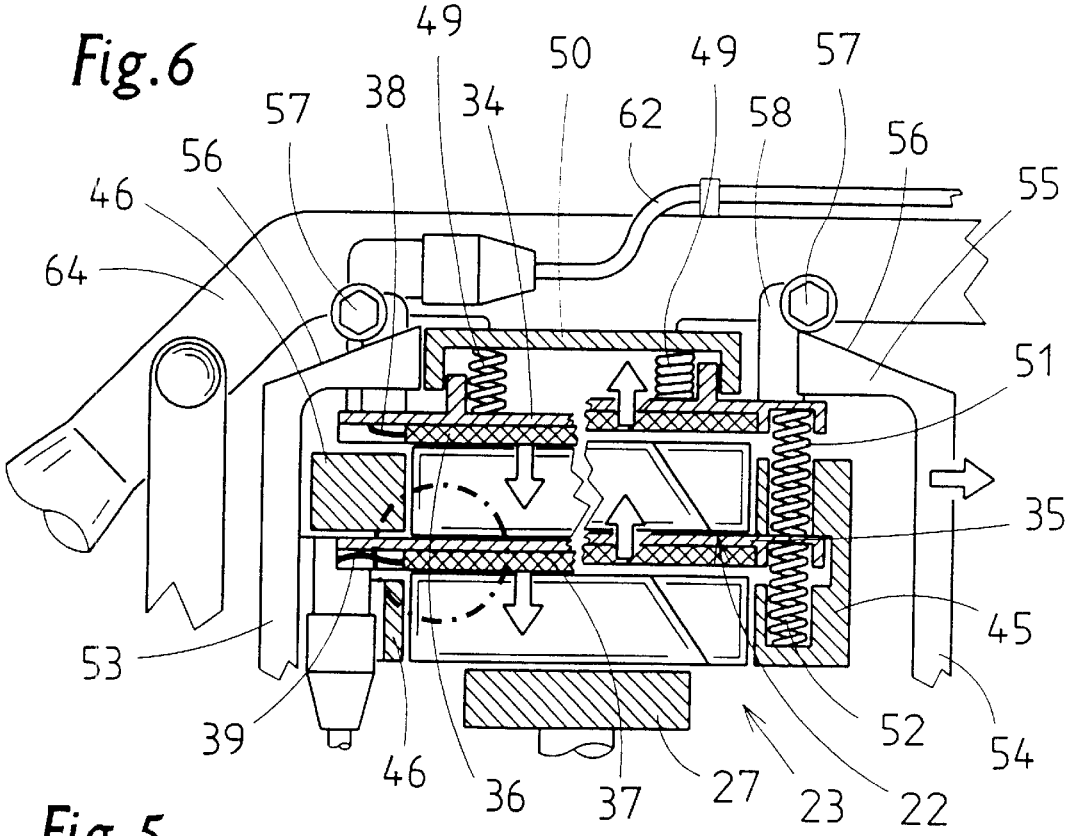
Figure 5:
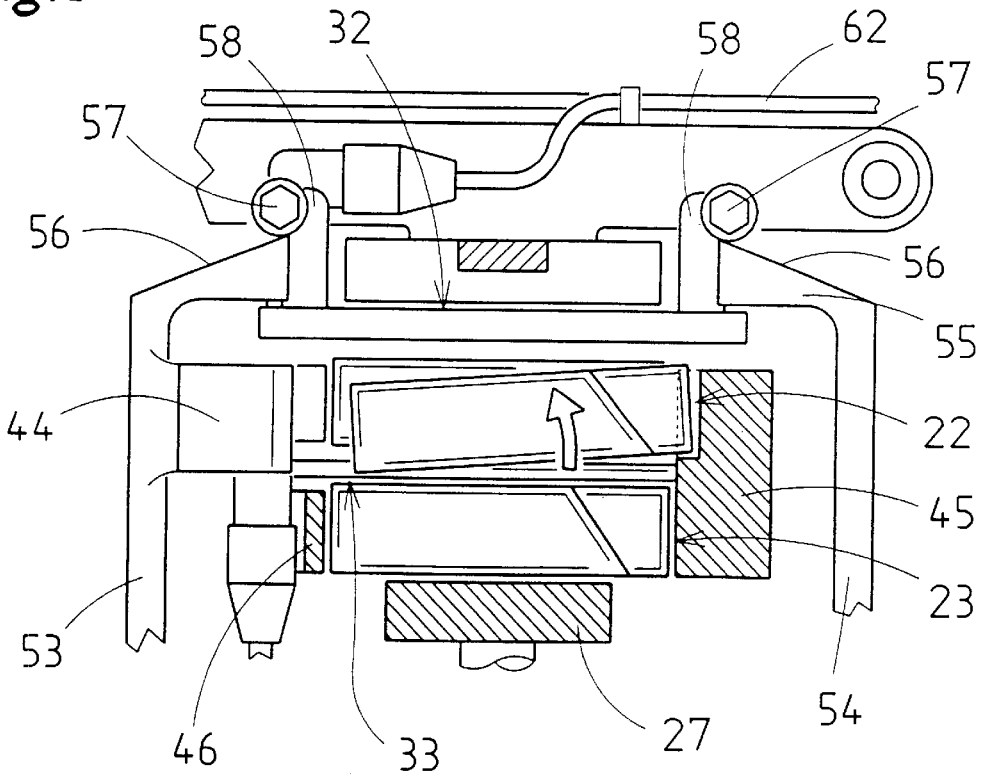
Figure 7:
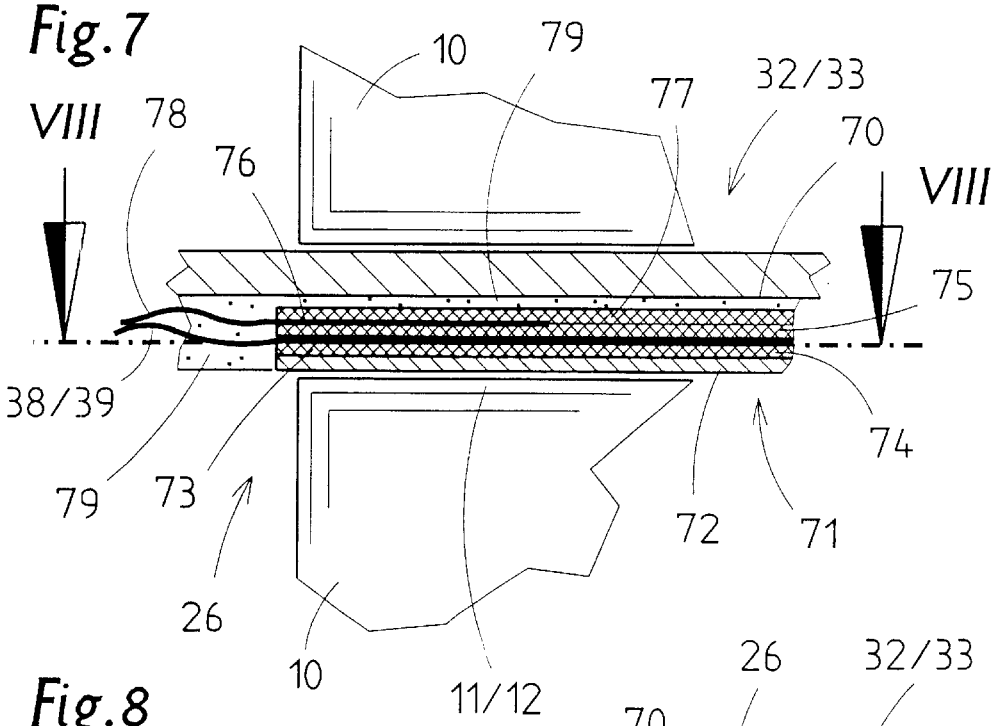
Figure 8:
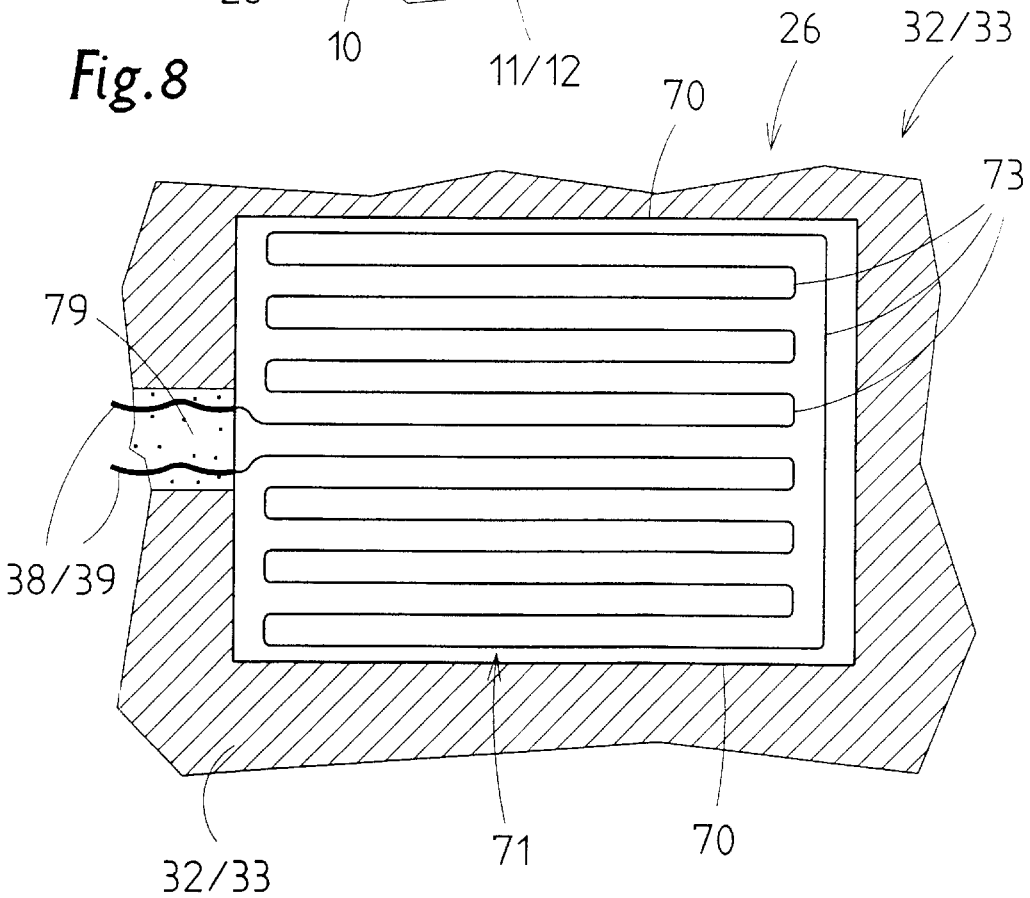

Further features of the process according to the invention and of the apparatus according to the invention are explained in more detail hereinbelow with reference to the drawings, in which:

FIG. 1 shows a schematic side view of a (film-) packaging machine,

FIG. 2 shows, on an enlarged scale and partially in vertical section, a side view of the region of a sealing and shrinking station of the packaging machine, FIG. 3 shows a plan view of the region of the sealing and shrinking station, FIG. 4 shows a cross section through the shrinking station from FIG. 3 along section plane IV—IV, FIG. 5 shows, on an enlarged scale, a detail from FIG. 4 with elements in different positions relative to one another, FIG. 6 shows likewise a cross section through the shrinking station with movable elements in yet different positions relative to one another, FIG. 7 shows, on an enlarged scale, a detail of a shrinking and/or heating plate in vertical section, and FIG. 8 shows a horizontal section of the detail according to FIG. 7 along section plane VIII—VIII.

The exemplary embodiment illustrated in the drawings concerns the handling of cuboidal packs 10, namely hinge-lid boxes (hinge-lid packs) for cigarettes. This type of pack comprises a (bottom) box part 11 and a lid 12 connected thereto. The pack is enclosed by an outer wrapper 13 made of film. The latter is folded such that in particular envelope-design folding tabs are produced in the region of the end wall 14 and base wall 15, so said folding tabs partially overlapping one another and being connected to one another by thermal sealing.

The outer wrapper 13 or blank for forming the same is prepared in a film-packaging machine according to FIG. 1—a so-called cello—and is positioned around the otherwise finished pack 10. For this purpose, the blanks of the outer wrapper 13 are severed from a film web in the region of a blank subassembly 17 and are fed to the packs 10, which are transported in a horizontal plane. A folding turret 18 folds the outer wrapper 13 around the pack 10. In the region of a horizontal pack path, the packs 10 leave the folding turret 18. The packs 10 which have been completed with regard to the outer wrapper 13 are transferred to a vertical conveyor 20, which feeds the packs 10, arranged one above the other, to a push-off path 21.

In the region of said push-off path 21, a multilayered formation of the packs 10 is formed, in the present example with two pack rows 22, 23 one above the other. For this purpose, the packs 10 are pushed off cyclically in pairs from the upright grouping by a pusher 24.

As seen in the conveying direction of the packs 10, first of all a sealing station 25 and then a shrinking station 26 are formed in the region of the push-off path 21. Accordingly, the packs 10 or the pack rows 22, 23 are first of all subjected to sealing treatment in the region of the end wall 14 and base wall 15 and then to shrinkage treatment, both treatments involving heat being fed.

In the region of the push-off path 21, the pack rows 22, 23 rest on a track plate 27 extending in the longitudinal direction. The latter is considerably narrower than the dimension or height of the packs 10, which are oriented in the transverse direction. In the case of the exemplary embodiment illustrated, the apparatus is set up for double-path operation, that is to say with two parallel conveying paths 28, 29 one beside the other. Said two conveying paths are of largely corresponding design in the region of the push-off path 21. The elements assigned to the conveying paths 28, 29 operate cyclically and at the same time for the two conveying paths 28, 29.

The first region, as seen in the conveying direction, of the push-off path 21 is the sealing station 25. In this region, sealing elements, namely lateral sealing jaws 30, 31, are positioned on both sides of the pack rows 22, 23, said elements being directed towards the facing end walls 14 and base walls 15 of the packs 10. The sealing jaws 30, 31 can preferably be moved transversely to the conveying direction of the packs 10 such that the sealing jaws 30, 31 are drawn back during a conveying cycle of the packs 10 and butt against the end wall 14 and base wall 15 during a standstill phase of the packs 10, heat being transmitted for the purpose of sealing the folding tabs in the process.

In the region of the shrinking station 26, heat is transmitted to the large-surface-area sides of the packs 10. In the present case, the shrinking station 26 is set up such that heat is transmitted only to the upwardly directed front sides of the packs 10. For this purpose, the shrinking station 26 has sheet-like heating elements, namely a top heating plate 32 and a bottom heating plate 33. The heat is transmitted by the heating plates 32, 33 butting against the top sides (front sides) of the packs 10. A special feature is that the bottom heating plate 33 is positioned in the region between the pack rows 22, 23. For this purpose, the packs 10 of the top pack row 22 are raised in the region of the heating plates 32, 33, with the result that the packs are conveyed above the bottom heating plate 33. Each heating plate 32, 33 comprises a (top) carrying plate 34, 35 and a sheet-like heating element 36, 37 provided on the underside of the same in each case. The heating elements, in this case, are electrical resistance-heating means which are supplied with power via lines 38, 39. During transportation of the packs 10, the heating plates 32, 33 are raised from the associated packs 10; during the heating and/or shrinking phase, the relevant heating plates 32, 33 and the heating elements 36, 37 thereof butt against the top side of the packs 10.

The packs 10 are moved on, by the cyclic advancement, by in each case one conveying cycle corresponding to the dimension of the packs 10. The bottom or central heating plate 33 is provided with an inclined run-on surface 40 which makes it easier for the packs 10 of the top pack row 22 to be pushed into the bottom heating plate 33. In order to ensure correct advancement of the packs, the latter, in a region in front of the shrinking station 26, are subjected to loading by an elastic holding-down means 41 comprising a plurality of brushes 42.

In order for the packs 10 to be pushed onto the bottom heating plate 33 during the advancement, the pack 10 which is located in each case in a position in front of the heating plate 33 is displaced in the transverse direction onto a laterally arranged ramp 43, which is of wedge-like design in the conveying direction. The relevant pack 10 is displaced in the transverse direction out of the top pack row 22 by a transverse pusher 44 and then, during further transportation in the offset position, passes onto the laterally arranged ramp 43. This makes it easier for the packs to be pushed onto the heating plate 33. A side guide 45 is designed such that, during further transportation, the pack 10 resting first of all with a front region on the heating plate 33, on the one hand, passes in its entirety onto the heating plate 33 and, at the same time, is moved back in the transverse direction into the starting position, that is to say aligned within the pack row 22. The pack rows 22, 23 are also retained in a precise relative position on the opposite side by side guides 46. In order to facilitate the pushing-on action, the bottom heating plate 33 is provided, in plan view, with an obliquely running edge 47 as an initial boundary of the run-on surface 40. Following the heating and/or the shrinking operation, the packs 10 of the top pack row 22 run downwards, via a likewise obliquely directed end surface 48 of the heating plate 33, until they butt against the respectively associated pack 10 of the bottom pack row 23.

The heating plates 32, 33 can be moved up and down by a specific actuating mechanism. The latter acts on the top heating plate 32 which, for its part, transmits the movements to the bottom heating plate 33. By virtue of the mobility of heating plates 32, 33 in the upward direction, a smooth, frictionless feeding of the pack rows 22, 23 is possible in each case. For this purpose, the heating plates 32, 33 are subjected to loading by springs. The top heating plate 32 has (four) compression springs 49. These are supported, on the one hand, on the top side of the heating plate 32 and, on the other hand, on a supporting plate 50. The latter is arranged in a fixed manner. The compression springs 49 are pre-stressed such that, when relieved of loading, the heating plate 32 is pressed downwards by the compression springs 49 until it butts against the pack 10 (FIG. 6, on the left). For the purpose of raising the heating plate 32, the latter is moved upwards and raised from the pack 10 with the compression springs 49 being compressed (FIG. 6, on the right).

The bottom heating plate 33 is actuated by two groups of in each case a plurality of (four) springs. Top lowering springs 51 are supported at the top on an extension of the top heating plate 32, on the one hand, and on the top side of the bottom heating plate 33, on the other hand. During lowering of the top heating plate 32, pressure is thus transmitted to the bottom heating plate 33 via the lowering springs 51, with the result that said heating plate is correspondingly lowered until it butts against the pack 10. During the upward movement of the top heating plate 32, the lowering springs 51 are relieved of stressing (FIG. 6, on the right). The bottom heating plate 33 is raised by lifting springs 52 which are supported, on the one hand, on the underside of the bottom heating plate 33 and, on the other hand, on a fixed bearing, in the present case in a recess of the side guides 45, 46. The lifting springs 52 are compressed during the downward movement of the heating plates 32, 33. During the upward movement, that is to say relief from loading, said lifting springs 52 raise the bottom heating plate 33 from the bottom pack 10 (FIG. 6, on the right).

Transversely movable actuating levers 53, 54 are provided as actuating element. By virtue of transverse movement, they transmit the actuating forces to the heating plates, in the present case to the top heating plate. The arrangement here is such that, as described, the top heating plate is moved upwards by the actuating levers 53, 54 for the purpose of releasing the packs 10. For this purpose, a transversely directed leg 55 of the actuating levers 53, 54 is provided with a wedge surface 56. During transverse movement of the actuating levers 53, 54, said wedge surface transmits a lifting force to the top heating plate 32. For this purpose, a supporting roller 57 is connected to the top heating plate 32 in the region of the actuating levers 53, 54, said supporting roller, in turn, being fastened on the heating plate 32 via a web 58. The supporting roller 57 runs on the wedge surface 56. The arrangement is such that, as the actuating levers 53, 54 move sideways away from the packs, the supporting rollers 57 and thus the heating plate 32 are raised.

The (four) actuating levers 53, 54 are actuated by connecting rods 59, 60. These are directed horizontally and can be moved back and forth by an actuating element (not shown). If the apparatus is of double-path configuration, in each case two corresponding actuating levers 53 are connected to the associated connecting rod 59 and the other actuating levers 54 are connected to the other connecting rod 60, located there beneath. The connecting rods 59, 60 are guided, via slide bearings 61, through those actuating levers 53, 54 which are not actuated, that is to say displaced, by the relevant connecting rod 59, 60.

The movements are coordinated with one another such that the transverse pusher 44 is connected to one of the actuating levers 53, that is to say is actuated by the same. Furthermore, the holding-down means is connected to the supporting plate 50 and is thus likewise fixed.

For the supply of the heating elements 36, 37, the electric lines 38, 39 lead to connection lines 62, 63 which are routed above and beneath the conveying paths 28, 29.

In the case of the present exemplary embodiment, the top heating plates 32 can be raised for cleaning and maintenance purposes. For this purpose, the top heating plates 32 of the two conveying paths 28, 29 are connected to a transversely directed lifting arm 64. The latter is designed as a single-armed lever and can be pivoted about a bearing 65. A freely projecting handle 66 is arranged on the opposite side. By virtue of appropriate activation, the lifting arm 64 can be moved upwards into an oblique position (dashed position in FIG. 4). The important structural parts at the top of the heating plate 32, including the holding-down means 41, are connected to the lifting arm 64. The lifting arm 64 can be connected to a connecting leg 67 of a firmly anchored crossmember 68 running beneath the conveying paths 28, 29.

The correct movement of the packs 10 as they are pushed off from the bottom heating plate 33 is ensured by an obliquely directed and/or arcuate guide shoe 69.

An (independent) special feature is the configuration of the heating elements, namely of the heating plates 32, 33 (FIGS. 7 and 8). The carrying plates 34, 35 have a recess which is enclosed by a border and is open in the downward direction in each case. In each case, each heating element 36, 37 is provided in the form of a sheet-like heating element 71 positioned in said recess, with the result that, in the case of the present example, said heating element acts in the downward direction, that is to say it acts on a pack positioned beneath the heating element 71.

In the downward direction, or on the side directed towards the pack 10, the heating element 71 has a metal plate 72, in particular made of steel. The metal plate 72 is of comparatively thin design, namely with a thickness of, for example, 0.5 mm, with the result that quick heat transmission is ensured. Heating elements are positioned on the inside of the metal plate 72, or on that side of said plate which is directed away from the pack 10. Said heating elements are constituted by an electrical heating wire 73 which is positioned in loops, for example in meandering form. The heating wire is connected to a power source via the lines 38, 39. The heating wire 73 produces the necessary heating temperature in a surface region.

The heating wire 73 is embedded or positioned between layers made of suitable material, namely between a bottom mat 74 and a top mat 75. These mats 74, 75 consist of suitable material, in particular silicone with fibre and/or fabric reinforcement. The mats 74, 75 are suitable for the heat transmission.

Arranged above the mat 75, or on the side which is directed away from the heating wire 73, is a temperature sensor 76 which is covered and/or insulated from the carrying plate 34-, 35 by a further mat 77. With the aid of the temperature sensor 76, it is possible to determine the temperature present in the region of the heating plate 32, 33 and then to change said temperature if appropriate. The temperature sensor 76 is connected to a suitable control unit via a line 78.

The metal plate, 72, the heating wire 73 and the mats 74, 75 and, if appropriate, the temperature sensor 76 and the mat 77 form a cohesive unit. The individual layers are connected to one another, to be precise, in particular, by the silicone and metal layers being adhesively bonded or vulcanized to one another. Said unit is positioned in the recess 70 and anchored there by way of a suitable compound, in particular by way of an embedding compound 79 made of silicone.

Using a heating element 71 designed in this way and/or corresponding heating plates 32, 33, quick, immediate adaptation of the effective heating temperature to certain operating states is possible since the thin, virtually foil-like metal plate 72 transmits the temperature virtually without delay. As a result, in the case of an "immediate stop" of the machine with a continuing run of approximately three packs, the outer wrapper does not burn because the heating plates 32, 33, by virtue of connection to a central control unit, are switched off right away and are also cooled immediately by the incoming packs.

Adaptation to the operating states of the machine is such that, during a standstill, a temperature of 80° C. and, at a maximum conveying speed of, for example, 365 packs per minute, a temperature of 135° C. is produced, with correspondingly lower temperatures for lower production capacities.

Alternatively, it is also possible for the apparatus to be designed such that the two large-surface-area sides of the packs 10, that is to say the front side and rear side, are subjected to the action of heat. In this case, the bottom heating plate 33 is to be designed such that a heating element is arranged on the top side as well.

What is claimed is:

1. Apparatus for producing packs (20) with an outer wrapper (13) made of film provided by a film blank which is folded around the pack (10) and has tabs which are connected to one another by thermal sealing in the region of a sealing station (25), characterized by the following features:

a) the packs (10) are transportable cyclically along a straight conveying path in a plurality of pack rows (22, 23) arranged one above the other, b) a first region of the conveying path (28,29) comprises a seating station (25) with sealing jaws (30,31) arranged at either side of the conveying path (28,29) for sealing laterally directed folding tabs, and c) the sealing station (25) is followed in the region of the conveying path (28,29) by a shrinking station (26) for shrinking the outer wrapper (13) through the application of heat, wherein the shrinking station (26) comprises heating plates (32,33) which are movable against at least one side of the packs (10) for transmitting heat to the packs (10).

2. Apparatus according to claim 1, characterized in that the heating plates (32,33) are movable against an upwardly directed front side of the packs (10).

3. Apparatus according to claim 2, characterized by the following features:

a) during transport along a horizontal conveying path (28,29), the packs (10) of a top pack row (22) are conveyed in the upward direction such that the packs (10) of the top pack row (22) are conveyed over a bottom heating plate (33) assigned to the packs (10) of a bottom pack row (23), b) the bottom heating plate (33) has an obliquely directed run-on surface (40) for the packs (10) of the top pack row (22), c) the run-on surface (40) extends across the full transverse extent of the packs (10), and d) the run-on surface (40) has an oblique edge (47) as a boundary.

4. Apparatus according to claim 2, characterized by the following features:

a) during transport along a horizontal conveying path (28,29), the packs (10) of a top pack row (22) are conveyed in the upward direction such that the packs (10) of the top pack row (22) are conveyed over a bottom heating plate (33) assigned to the packs (10) of a bottom pack row (23), b) the bottom beating plate (33) has an obliquely directed run-on surface (40) for the packs (10) of the top pack row (22), c) the run-on surface (40) extends across the full transverse extent of the packs (10), and d) the run-on surface (40) has an oblique edge (47) as a boundary.

5. Apparatus according to claim 4, characterized in that a pack (10) of the top pack row (22) in a position before it runs onto the bottom beating plate (33) in each case is displaced in a transverse direction onto a laterally arranged ramp (43), and in that, in a further conveying cycle, the pack (10) resting with one side on the ramp (43) is pushed onto the bottom heating plate (33) with a simultaneous sideways-directed return movement into a starting position.

6. Apparatus according to claim 4, characterized in that the heating plates (32,33) are moved up and down together such that, during advancement of the packs (10), the heating plates (32,33) are raised from the packs (10) a top pack row (22) and of the bottom pack row (23).

7. Apparatus according to claim 6, characterized in that the heating plates (32, 33) are connected to one another by pressure-exerting elements comprising lowering springs (51) and lifting springs (52) for the bottom heating plate (33), the lowering springs (51) and lifting springs (52) being positioned such that, during an upward movement of a top heating plate (32), the bottom heating plate (33) is raised by the lifting springs (52).

8. Apparatus according to claim 6, characterized in that a top heating plate (32) is lowered by a transversely movable actuating mechanism with transversely movable actuating levers (53, 54) having wedge surfaces (56) which, via supporting rollers (57) connected to the top heating plate (32), raise the top heating plate (32) counter to the loading of pressing-down elements comprising compression springs (49).

9. Apparatus according to claim 1, characterized in that the heating plates (32, 33) have heating elements (71) which have heat-transmitting elements including very thin metal plates (72) which react immediately to changes in temperature, the packs (10) coming into abutment against the same or being moved past the same at a small distance therefrom.

10. Apparatus according to claim 9, characterized in that the heating elements (71) have heating members comprising electrical heating wires (73) which are arranged in loops or in meandering form and, on a side directed away from the packs (10), are connected to the metal plates (72) via a heat-conducting intermediate layer including a mat (74) made of silicone.

11. Apparatus according to claim 10, characterized in that the heating elements (71) are of multilayered construction, with heating wires (73), on the one hand, and a temperature sensor (76), on the other hand, being positioned between a plurality of mats (74,75,77), and the metal plates (72) and mats (74,75,77) are connected to one another to form a unit by adhesive bonding or vulcanization.

12. Apparatus according to claim 11, characterized in that a unit-design heating element (71) is positioned within a recess (70) of each heating plate (32, 33) by way of a moldable embedding compound (79) made of silicone.

13. Apparatus according to claim 9, characterized in that the heating elements (71) are of multilayered construction, with heating wires (73), on the one hand, and a temperature sensor (76), on the other hand, being positioned between a plurality of mats (74,75,77), and the metal plates (72) and mats (74, 75, 77) are connected to one another to form a unit by adhesive bonding or vulcanization.

14. Apparatus according to claim 13, characterized in that a unit-design heating element (71) is positioned within a recess (70) of each heating plate (32, 33) by way of a moldable embedding compound (79) made of silicone.

* * * * *

UNITED STATES PATENT AND TRADEMARK OFFICE

CERTIFICATE OF CORRECTION

PATENT NO. : 6,511,405 B1
DATED : January 28, 2003
INVENTOR(S) : Heinz Focke et al.

It is certified that error appears in the above-identified patent and that said Letters Patent is hereby corrected as shown below:

Title page,
Insert Item -- [30] Foreign Application Priority Data
September 15, 1999 (DE) 19944086.7
November 10, 1999 (DE) 19954169.8 --

Signed and Sealed this

Fifth Day of August, 2003

JAMES E. ROGAN
*Director of the United States Patent and Trademark Office*

US006511405C1

(12) EX PARTE REEXAMINATION CERTIFICATE (6527th)

United States Patent
Focke et al.

(10) Number: US 6,511,405 C1
(45) Certificate Issued: Nov. 18, 2008

(54) PROCESS AND APPARATUS FOR PRODUCING CIGARETTE PACKS

(75) Inventors: Heinz Focke, Verden (DE); Thomas Häfker, Langwedel (DE)

(73) Assignee: Focke & Co. (GmbH & Co.), Verden (DE)

Reexamination Request:
No. 90/007,966, Mar. 9, 2006

Reexamination Certificate for:

| | |
|---|---|
| Patent No.: | **6,511,405** |
| Issued: | **Jan. 28, 2003** |
| Appl. No.: | **09/663,469** |
| Filed: | **Sep. 15, 2000** |

Certificate of Correction issued Aug. 5, 2003.

(30) Foreign Application Priority Data

| | | |
|---|---|---|
| Sep. 15, 1999 | (DE) | 199 44 086 |
| Nov. 10, 1999 | (DE) | 199 54 169 |

(51) Int. Cl.
*B31B 1/48* (2006.01)

(52) U.S. Cl. ..... 493/70; 53/234; 53/557; 493/129

(58) Field of Classification Search ..... 53/557
See application file for complete search history.

(56) References Cited

U.S. PATENT DOCUMENTS

| | | | | | |
|---|---|---|---|---|---|
| 3,262,245 | A | * | 7/1966 | Snow, Jr. | 53/557 |
| 3,600,875 | A | * | 8/1971 | Buob et al. | 53/442 |
| 4,108,713 | A | | 8/1978 | Weisz | |
| 4,641,482 | A | * | 2/1987 | Metz | 53/387.3 |
| 4,843,800 | A | * | 7/1989 | Focke | 53/477 |

FOREIGN PATENT DOCUMENTS

| | | | |
|---|---|---|---|
| DE | 3824924 | * | 1/1990 |
| EP | 1084954 | | 3/2001 |
| GB | 1231352 | * | 5/1971 |

OTHER PUBLICATIONS

Bibliographical data in English for DE 3,824,924, printed from the Internet via Esp@cenet of the European Patent Office on Jun. 30, 2006.
Standard ST.9 of the World Intellectual Property Organization, Appendix 1, p. 3.9.6, Feb. 2004.

* cited by examiner

*Primary Examiner*—Jimmy Foster

(57) ABSTRACT

In order to improve the outer appearance of (cigarette) packs (10) of the hinge-lid-box type, said packs, once an outer wrapper (13) has been provided and sealed, are conveyed through a shrinking station (26) and subjected to the action of heat in the region of the large-surface-area pack sides, in particular in the region of upwardly directed front sides. For this purpose, heating plates (32, 33) are positioned in the region of the shrinking station (26) and transmit heat to the upwardly directed surfaces of the packs (10).

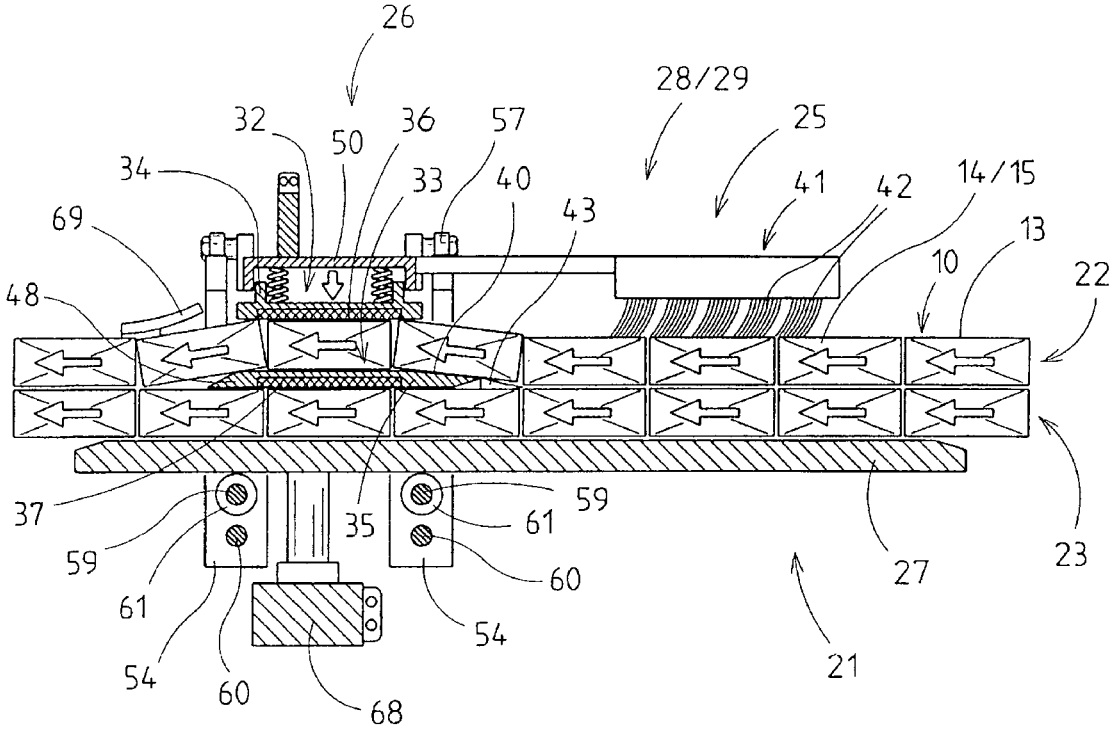

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–4 are cancelled.

Claims 5, 6 and 9 are determined to be patentable as amended.

Claims 7, 8 and 10–14, dependent on an amended claim, are determined to be patentable.

5. Apparatus according to claim [4] *6*, characterized in that a pack (10) of the top pack row (22) in a position before [it] *the pack* (*10*) runs onto the bottom [beating] *heating* plate (33) in each case is displaced in a transverse direction onto a laterally arranged ramp (43), and in that, in a further conveying cycle, the pack (10) resting with one side on the ramp (43) is pushed onto the bottom heating plate (33) with a simultaneous sideways directed return movement into a starting position.

6. Apparatus [according to claim 4, characterized in that] (*20*) *for producing packs* (*10*) *with an outer wrapper* (*13*) *made of film provided by a film blank which is folded around the pack* (*10*) *and has tabs which are connected to one another by thermal sealing in the region of a sealing station* (*25*), *characterized by the following features:*

*a*) *the packs* (*10*) *are transportable cyclically along a straight conveying path in a plurality of pack rows* (*22,23*) *arranged one above the other;*

*b*) *a first region of the conveying path* (*28,29*) *comprises a sealing station* (*25*) *with sealing jaws* (*30,31*) *arranged at either side of the conveying path* (*28,29*) *for sealing laterally directed folding tabs;*

*c*) *the sealing station* (*25*) *is followed in the region of the conveying path* (*28,29*) *by a shrinking station* (*26*) *for shrinking the outer wrapper* (*13*) *through the application of heat, wherein the shrinking station* (*26*) *comprises heating plates* (*32,33*) *which are movable against at least one side of the packs* (*10*) *for transmitting heat to the packs* (*10*), *including the heating plates* (*32,33*) *being movable against an upwardly directed front side of the packs* (*10*);

*d*) *during transport along a horizontal conveying path* (*28,29*), *the packs* (*10*) *of a top pack row* (*22*) *are conveyed in the upward direction such that the packs* (*10*) *of the top pack row* (*22*) *are conveyed over a bottom heating plate* (*33*) *assigned to the packs* (*10*) *of a bottom pack row* (*23*);

*e*) *the bottom heating plate* (*33*) *has an obliquely directed run-on surface* (*40*) *for the packs* (*10*) *of the top pack row* (*22*);

*f*) *the run-on surface* (*40*) *extends across the full transverse extent of the packs* (*10*); *and*

*g*) *the run-on surface* (*40*) *has an oblique edge* (*47*) *as a boundary; and*

*h*) the heating plates (32,33) are moved up and down together such that, during advancement of the packs (10), the heating plates (32,33) are raised from the packs (10) *of* a top pack row (22) and of the bottom pack row (23).

9. Apparatus according to claim [1] *6*, characterized in that the heating plates (32, 33) have heating elements (71) which have heat-transmitting elements including very thin metal plates (72) which react immediately to changes in temperature, the packs (10) coming into abutment against the same or being moved past the same at a small distance therefrom.

* * * * *